US011986141B2

(12) United States Patent
Choi

(10) Patent No.: US 11,986,141 B2
(45) Date of Patent: May 21, 2024

(54) CONTROL METHOD OF DISHWASHER

(71) Applicant: LG Electronics Inc., Seoul (KR)

(72) Inventor: Jang Yeal Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/572,961

(22) Filed: Jan. 11, 2022

(65) Prior Publication Data

US 2022/0218177 A1 Jul. 14, 2022

(30) Foreign Application Priority Data

Jan. 11, 2021 (KR) ..... 10-2021-0003415

(51) Int. Cl.
*A47L 15/00* (2006.01)
*A47L 15/42* (2006.01)

(52) U.S. Cl.
CPC ..... *A47L 15/0034* (2013.01); *A47L 15/0063* (2013.01); *A47L 15/4259* (2013.01); *A47L 2501/22* (2013.01)

(58) Field of Classification Search
CPC ..... A47L 15/00–508; D06F 21/00–14; D06F 23/00–065; D06F 25/00; D06F 33/00–76; D06F 34/00–34; D06F 35/00–008; D06F 37/00–42; D06F 39/00–14
See application file for complete search history.

(56) References Cited

U.S. PATENT DOCUMENTS

2006/0283482 A1* 12/2006 Berends ..... A47L 15/0034 134/25.2
2015/0019017 A1 1/2015 Bodine et al.
2015/0293227 A1* 10/2015 Taoka ..... A47L 25/00 356/338
2018/0000311 A1* 1/2018 Ryu ..... A47L 15/22

FOREIGN PATENT DOCUMENTS

| | | | |
|---|---|---|---|
| CN | 108742451 | | 11/2018 |
| CN | 108742451 | A * | 11/2018 |
| CN | 113349702 | | 9/2021 |
| EP | 0953315 | | 11/1999 |
| EP | 1733675 | | 9/2008 |
| EP | 3263005 | | 1/2018 |
| KR | 20200023976 | | 3/2020 |

OTHER PUBLICATIONS

Extended European Search Report in European Appln. No. 22150706.4, dated May 27, 2022, 8 pages.

* cited by examiner

*Primary Examiner* — Mikhail Kornakov
*Assistant Examiner* — Richard Z. Zhang
(74) *Attorney, Agent, or Firm* — Fish & Richardson P.C.

(57) ABSTRACT

A method of controlling a dishwasher includes: linking the dishwasher to an air quality detection device provided at an outside of the dishwasher, receiving information regarding activation of an auto open door (AOD) function of the dishwasher, determining whether a quality of indoor air input from the air quality detection device is within a set range, based on determining that the quality of the indoor air (Continued)

deviates from the set range, recommending a user of the dishwasher to deactivate the AOD function of the dishwasher, maintaining or deactivating the AOD function of the dishwasher based on a command input from the user, and washing a washing target in the dishwasher.

13 Claims, 9 Drawing Sheets

CONTROL METHOD OF DISHWASHER

CROSS-REFERENCE TO RELATED APPLICATION

This application claims priority to and the benefit of Korean Patent Application No. 10-2021-0003415, filed in Korea on Jan. 11, 2021, the disclosure of which is incorporated herein by reference in its entirety.

BACKGROUND

1. Field of the Invention

The present disclosure relates to a method of controlling a dishwasher, and more particularly, to a method of controlling a dishwasher which controls opening or closing of a door of the dishwasher.

2. Discussion of Related Art

Contents described in this section merely provide background information on the present disclosure and do not constitute the related art.

In general, dishwashers are devices that spray washing water to accommodated dishes at a high pressure, wash the dishes, and then dry the dishes. In detail, the dishwashers are operated so that the washing water is sprayed at a high pressure into a tub in which the dishes are accommodated, and the sprayed washing water comes into contact with the dishes to wash foreign substances such as food waste stuck to the surfaces of the dishes.

The dishwasher generally includes the tub forming a washing chamber and a sump mounted on a bottom of the tub to store the washing water.

Further, the washing water is moved to a spray arm by pumping action of a washing pump mounted inside the sump, and the washing water having been moved to the spray arm is sprayed at a high pressure through a spray port formed in the spray arm.

Further, the washing water sprayed at a high pressure collides with the surface of a washing target, and thus dirt stuck to the washing target falls to the bottom of the tub.

After the washing using the washing water is completed during the operation of the dishwasher, the dishes that are the washing targets may be dried. In this case, for efficient drying, a door of the dishwasher may be opened during a partial section of the drying process for the dishes.

When the door of the dishwasher is opened, foreign substances floating in the interior may flow into the dishwasher and contaminate the washed dishes. Thus, a method of suppressing occurrence of the contamination of dishes, which may occur when the door of the dishwasher is opened, is required.

European Patent No. EP1733675B1 (hereinafter, referred to as related art 1) discloses a dishwasher equipped with a pivotal door and a method of operating the same. Korean Patent Application Publication No. 10-2020-0023976 (hereinafter, referred to as related art 2) discloses a control method of opening or closing a door in a dishwasher equipped with the door.

However, related art 1 and related art 2 do not disclose a method of measuring the degree of contamination of indoor air and opening or closing a door according to the measurement result.

SUMMARY OF THE INVENTION

The present disclosure is directed to providing a method of controlling a dishwasher, which controls opening of a door of the dishwasher during a drying process in the dishwasher having an auto open door (AOD) function.

The present disclosure is also directed to providing a method of controlling a dishwasher which suppresses foreign substances from penetrating into the dishwasher having an open door.

The present disclosure is also directed to providing a method of controlling a dishwasher which controls an operation of the door of the dishwasher using a mobile device carried by a user.

The purposes of the present disclosure may be not limited to the purposes described above, and other purposes and advantages of the present disclosure that are not described may be understood by the following description and may be more clearly understood by embodiments of the present disclosure. Further, it may be easily identified that the purposes and advantages of the present disclosure may be implemented by units and combinations thereof described in the appended claims.

A control system for a dishwasher according to an embodiment may include a dishwasher, an air quality detection device, and a mobile device.

The air quality detection device may be provided in an indoor space in which the dishwasher is disposed and may be disposed separately from the dishwasher. The air quality detection device may be disposed separately from the dishwasher in the indoor space in which the dishwasher is disposed.

The air quality detection device may be a device that may detect a contamination level of indoor air and transmit the detected information to the mobile device.

The air quality detection device may communicate with the mobile device in a wireless manner and may be, for example, an air purifier or an air conditioner sold as home appliances or an air contamination measurement device provided in each house in an apartment complex.

The mobile device may be, for example, a smart phone, a tablet personal computer (PC), or the like that a user may carry. The mobile device may be provided to communicate with the dishwasher and the air quality detection device, and an application that links the dishwasher and the air quality detection device may be registered in the mobile device.

A method of controlling a dishwasher according to an embodiment may include the following processes.

The application may link the dishwasher and the air quality detection device, which is provided outside the dishwasher, with each other. Due to the linking, the air quality detection device and the dishwasher may be connected to communicate with the mobile device.

The application may receive, from the user, whether or not to activate an auto open door (AOD) function of the dishwasher. For example, the application may open a pop-up window on an interface of the mobile device, and receive, from the user through the pop-up window, a command related to whether or not to automatically open the door during a drying process.

When a command of activating the AOD function is input from the user, the application may determine whether or not the quality of the indoor air input from the air quality detection device is within a set range.

When the quality of the indoor air deviates from the set range, the application may recommend the user to deactivate AOD of the dishwasher. When the quality of the indoor air deviates from the set range, the quality of the indoor air is in a bad state, and thus the application may display a text or emit a voice through the mobile device so as to recommend the user to deactivate the AOD.

The application may maintain or deactivate the AOD function of the dishwasher on the basis of a command input from the user.

The dishwasher may wash a washing target in a state in which the AOD function is maintained or deactivated according to the performance of the respective processes described above.

A process of drying the washing target may be performed in the following order.

The washing may be performed by the dishwasher. The application may determine whether or not the washing target, that is, a dish, enters a drying operation.

The application may receive information on the washing process from the dishwasher 1200, and accordingly, may determine whether or not the washing target enters the drying operation by the dishwasher.

When the washing target enters the drying operation, the application may determine whether or not the AOD of the dishwasher is activated. The application may receive the control-related information from the dishwasher, and accordingly, determine whether or not the AOD is activated.

When the AOD is activated, the application may determine whether or not the quality of the indoor air input from the air quality detection device is within the set range.

When the quality of the indoor air deviates from the set range, the application may recommend the user to deactivate the AOD of the dishwasher. When the quality of the indoor air deviates from the set range, the quality of the indoor air is in a bad state, and thus the application may display a text or emit a voice through the mobile device so as to recommend the user to deactivate the AOD.

The application may maintain or deactivate the AOD function of the dishwasher on the basis of the command input from the user.

The dishwasher may dry the washing target in a state in which the AOD function is maintained or deactivated according to the performance of the respective processes described above.

In the method of controlling a dishwasher according to the present disclosure, when the quality of the indoor air is bad because many foreign substances are present in the indoor space, control is made to deactivate the AOD function in the drying operation of the dishwasher, and thus the foreign substances can be effectively suppressed from penetrating into the dishwasher during the washing process for the dish and being thus attached to the dish.

Further, in the method of controlling a dishwasher according to the present disclosure, the application may recommend the user whether to maintain or deactivate the AOD function of the dishwasher, and the determination is made according to the command of the user. Thus, the convenience of selection can be provided to the user.

Further, in the method of controlling a dishwasher according to the present disclosure, by controlling an operation of the door of the dishwasher using the mobile device carried by the user, a user's convenience can be increased.

Further, in the method of controlling a dishwasher according to the present disclosure, an air purifier or an air conditioner that is a separate product that is already installed or is installable or an air contamination measurement device that is provided in each house in an apartment complex is used as the air quality detection device that detects the quality of the indoor air. Thus, since there is no need to add a separate device to the dishwasher, manufacturing costs of the dishwasher can be reduced.

In addition to the above-described effects, the detailed effects of the present disclosure will be described together while specific details for implementing the disclosure are described below.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
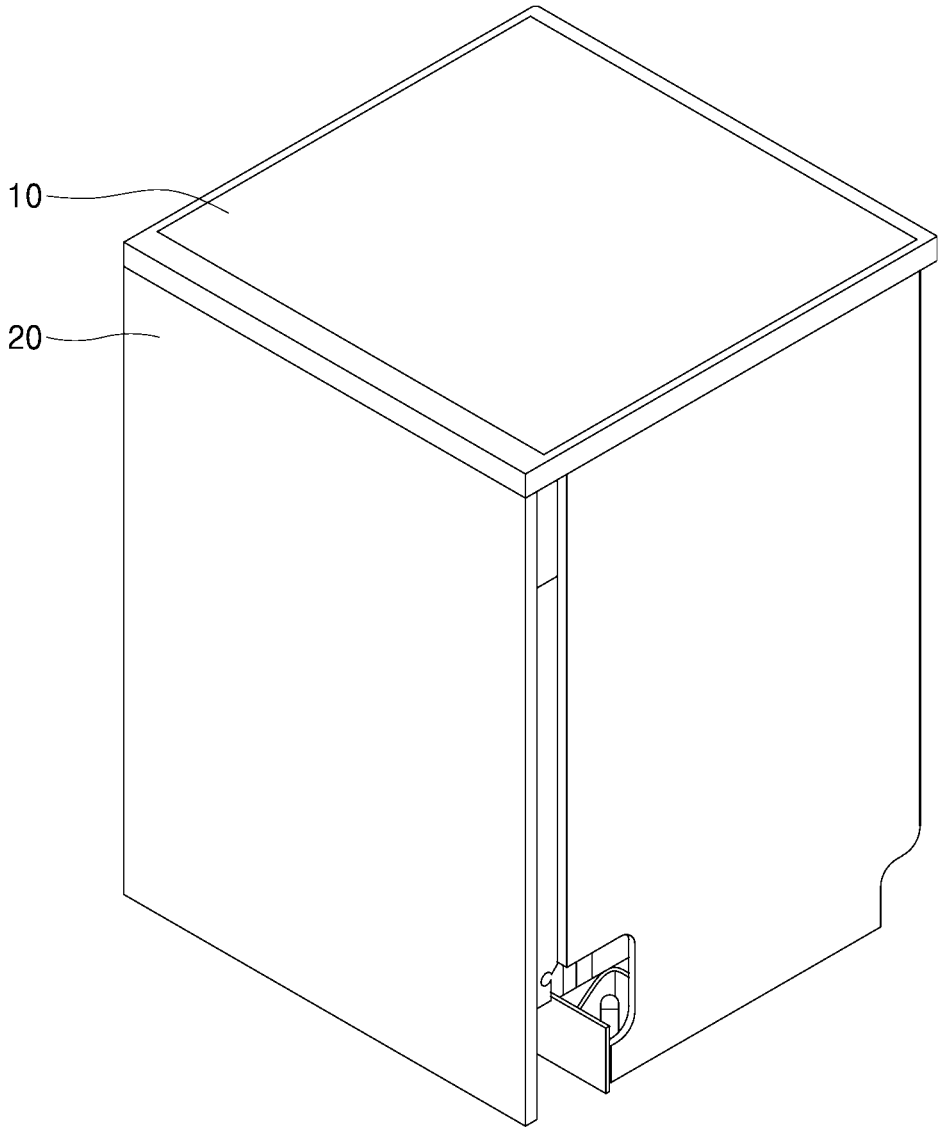
FIG. 1 is a perspective view illustrating an exterior of a dishwasher according to an embodiment.

The above-described purposes, features, and advantages will be described in detail with reference to the accompanying drawings, and accordingly, those skilled in the art to which the present disclosure pertains may easily implement the technical spirit of the present disclosure. In the description of the present disclosure, when it is determined that a detailed description of widely known technologies related to the present disclosure may make the subject matter of the present disclosure unclear, the detailed description be omitted. Hereinafter, embodiments of the present disclosure will be described in detail with reference to the accompanying drawings. In the drawings, the same reference numerals are used to indicate the same or similar components.

Although first, second, and the like are used to describe various components, it is apparent that these components are not limited by these terms. These terms are only used to distinguish one component from another component, and it is apparent that a first component may be a second component unless particularly otherwise stated.

Throughout the specification, unless particularly otherwise stated, each component may be singular or plural.

Singular expressions used herein include plural expressions unless clearly otherwise indicated in the context. In the present application, terms such as "configuring" or "including" should not be interpreted as necessarily including all of various components or various steps described in the specification and should be interpreted as not including some components or some steps thereof or further including additional components or additional steps.

Throughout the specification, when "A and/or B" is used, this means A, B or A and B unless otherwise stated, and when "C to D" is used, this means that a value is greater than or equal to C and less than or equal to D unless otherwise stated.

Figure 2:
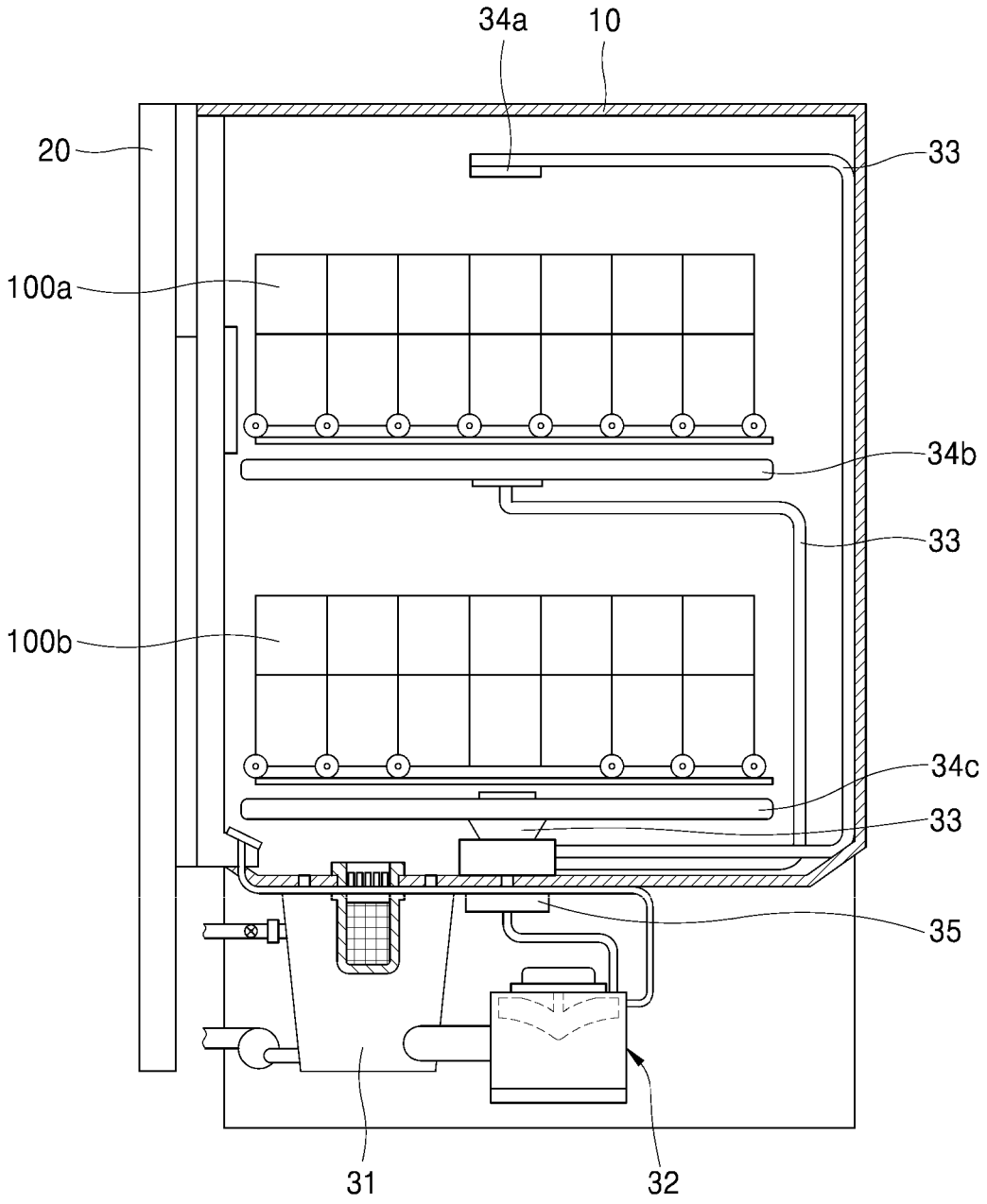
FIG. 2 is a schematic cross-sectional view of the dishwasher according to the embodiment.

FIG. 1 is a perspective view illustrating an exterior of a dishwasher according to an embodiment. FIG. 2 is a schematic cross-sectional view of the dishwasher according to the embodiment. An overall configuration of the dishwasher will be briefly described with reference to FIGS. 1 and 2.

The dishwasher may be used while being built-in in a space such as a kitchen. The dishwasher according to the embodiment may include a tub 10 that forms a space in which a dish is washed and has one open side, a door 20 that opens or closes the one open side of the tub 10, and an accommodation rack 100 which is disposed inside the tub 10 and in which the dish is accommodated.

The dishwasher according to the embodiment may be provided with the tub 10 that has a washing chamber formed therein and has an open front surface. Inside the tub 10, a space in which the dish that is a washing target may be accommodated may be formed, the rack 100 in which the dish is accommodated may be provided, and a washing module that washes the accommodated dish may be provided.

The dishwasher may include the door 20 that is rotatably connected to the tub 10 and opens or closes the open front surface of the tub 10. The door 20 may be rotatably connected to one side of the tub 10 and, more particularly, may be rotatably connected to an upper side and a lower side of the one side.

The door 20 and the tub 10 may be hinge-coupled to each other. That is, the door 20 may rotate about a door rotary shaft disposed at a front lower end of the tub 10.

The dishwasher includes a sump 31 that is disposed below the tub 10 and temporarily stores washing water supplied to the tub 10. A filter for filtering foreign substances from the washing water flowing from the tub 10 may be disposed in the sump 31.

The dishwasher may include a water supply pipe that supplies the washing water to the sump 31, a water supply valve that opens or closes the water supply pipe, and a drainage pipe and a drainage pump that discharge the washing water in the sump 31 to the outside.

The dishwasher includes a plurality of washing nozzles 34 that spray the washing water to the washing chamber. The plurality of washing nozzles 34 may spray the washing water toward an inner surface of the rack 100 or the tub 10.

A first washing nozzle 34*a* may be disposed above the tub 10 and spray the washing water to the lower side. A second washing nozzle 34*b* may be disposed below an upper rack 100*a* and spray the washing water to the upper rack 100*a* located on the upper side thereof. A third washing nozzle 34*c* may be disposed below a lower rack 100*b* and spray the washing water to the lower rack 100*b* located on the upper side thereof.

The dishwasher may include a washing pump 32 that is disposed below the tub 10 and pumps the washing water stored in the sump 31 to the plurality of washing nozzles 34.

The dishwasher may include a plurality of connection pipes 33 that guide the washing water pumped from the washing pump 32 to the plurality of washing nozzles 34.

The dishwasher may include a switching valve 35 that selectively guides the washing water pumped from the washing pump 32 to the plurality of connection pipes 33.

The washing water supplied to the tub 10 is collected in the sump 31 disposed below the tub 10. The washing water collected in the sump 31 flows to the washing pump 32 and is pressurized. The washing water pressed by the washing pump 32 flows to the switching valve 35 and selectively flows to the plurality of connection pipes 33. The washing water flows through the connection pipes 33 and is pumped to the washing nozzles 34.

The washing water pumped to the washing nozzles 34 is sprayed to the tub 10 and is collected in the sump 31 disposed below the tub 10 again.

A heater that heats the washing water may be further included in the washing pump 32. The heater may heat the washing water inside the washing pump 32 to generate steam.

The dishwasher may further include a steam nozzle that branches off from the washing pump 32 and communicates with one side of the tub 10. The generated steam may be sprayed to the tub 10 through the steam nozzle.

When the dish that is the washing target is washed using a dishwasher 1200, a process of drying the dish may be performed after the dish is washed using the washing water. During the drying process of the dishwasher 1200, the door may be opened for more efficient drying. In general, the dishwasher 1200 has an auto open door (AOD) function that automatically opens the door at a predetermined time point during the drying process.

Meanwhile, when flowing foreign substances such as dust and exhaust gas are present in an indoor space in which the dishwasher 1200 is disposed, the foreign substances may penetrate into the dishwasher 120 having an open door. When foreign substances penetrate into the dishwasher 1200 and adhere to the surface of the accommodated dish, there is a bothersomeness of having to wash the dish that has already been washed with the washing water again.

In particular, a user who is sensitive to foreign substance such as dust has a negative view on the AOD function, and accordingly, the demand for the dishwasher 1200 equipped with the AOD function may be reduced.

In a control method for the dishwasher 1200 according to the embodiment, a method of controlling the opening of the door of the dishwasher 1200 during the drying process in the dishwasher 1200 equipped with the AOD function to suppress foreign substances from penetrating into the dishwasher 1200 having the open door is proposed.

Figure 3:
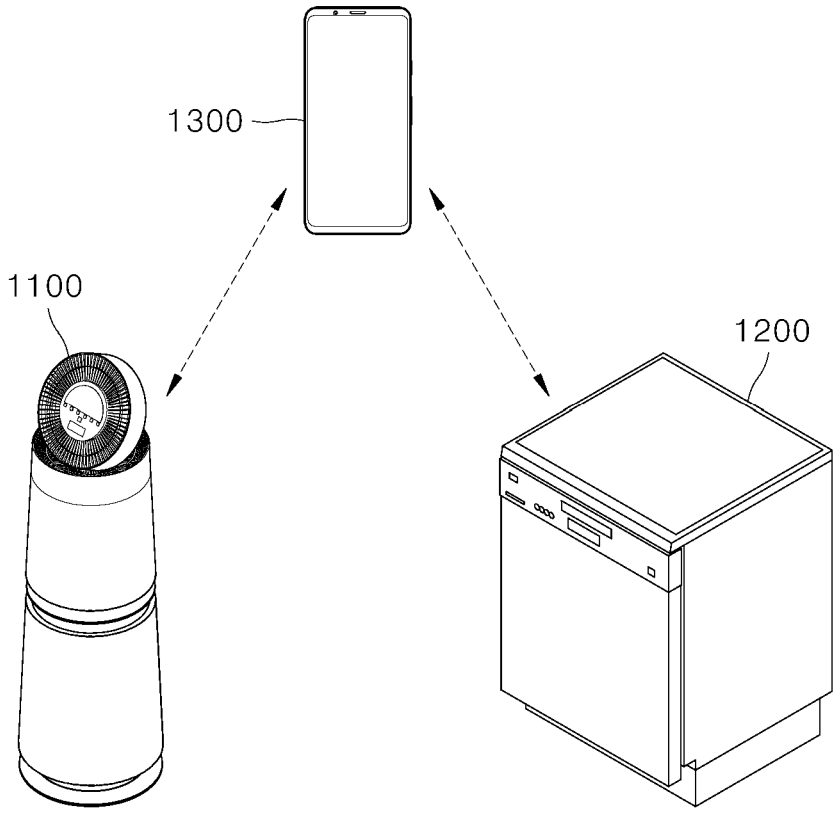
FIG. 3 is a view illustrating a control system for the dishwasher according to the embodiment.

FIG. 3 is a view illustrating a control system for the dishwasher 1200 according to the embodiment. FIG. 3 illustrates the control system including the dishwasher 1200 to implement the above-described method of controlling the dishwasher 1200.

The control system according to the embodiment may include the dishwasher 1200, an air quality detection device 1100, and a mobile device 1300.

The air quality detection device may be provided in the indoor space in which the dishwasher 1200 is disposed or may be disposed separately from the dishwasher 1200. That is, the air quality detection device 1100 may be disposed separately from the dishwasher 1200 in the indoor space in which the dishwasher 1200 is disposed.

The air quality detection device 1100 may be a device capable of detecting a contamination level of indoor air and transmitting the detected information to the mobile device 1300.

The air quality detection device 1100 may communicate with the mobile device 1300 in a wireless manner, and may be, for example, an air purifier or an air conditioner sold as home appliances or an air contamination measurement device provided in each household in an apartment complex.

The mobile device 1300 may be, for example, a smart phone, a tablet personal computer (PC), or the like that the user may carry. The mobile device 1300 may be provided to communicate with the dishwasher 1200 and the air quality detection device 1100, and an application that links the dishwasher 1200 and the air quality detection device 1100 may be registered in the mobile device 1300.

Figure 4:
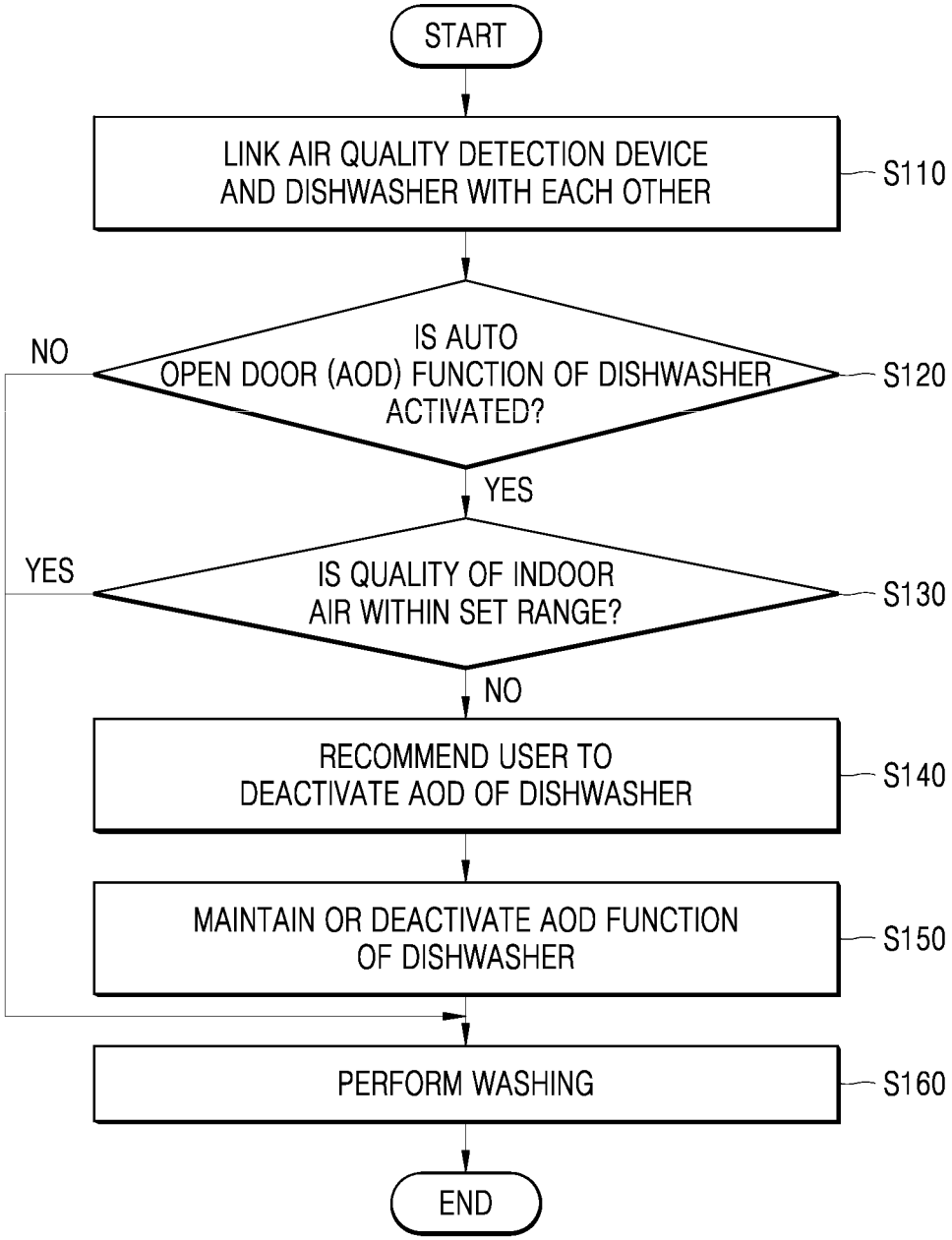
FIG. 4 is a flowchart for describing a method of controlling a dishwasher according to the embodiment.

FIG. 4 is a flowchart for describing a method of controlling the dishwasher 1200 according to the embodiment.

In order to control the dishwasher 1200, first, the air quality detection device 1100 and the dishwasher 1200 need to be linked with each other. In this case, the linking between the air quality detection device 1100 and the dishwasher 1200 may be implemented by an application registered in the mobile device 1300 of the user.

Hereinafter, each process of controlling the dishwasher 1200 described below, except for a dishwasher-specific process including an operation of opening or closing the door of the dishwasher 1200 and a process of detecting the quality of the indoor air, may be performed by the application registered in the mobile device 1300 as a whole.

For example, the application may open a pop-up window on a display-type interface of the mobile device 1300 to notify the user of information or receive a user's command.

The application may link the dishwasher 1200 and the air quality detection device 1100, which is provided outside the dishwasher 1200, with each other (S110). Due to the linking, the air quality detection device 1100 and the dishwasher 1200 may be connected to communicate with the mobile device 1300.

Further, when the linking is made, the application provided in the mobile device 1300 may receive information on the quality of the indoor air from the air quality detection device 1100, and transmit, for example, a command of deactivating the AOD function to the dishwasher 1200.

The user may activate the application to perform operation S110 so as to proceed to each operation described below. Further, the user may terminate the activated application to deactivate the linking between the air quality detection device 1100 and the dishwasher 1200 so as not to proceed to each operation described below.

After the air quality detection device 1100 and the dishwasher 1200 are linked by the application, the application may perform control related to an AOD of the dishwasher 1200.

That is, the application may receive whether or not the AOD function of the dishwasher 1200 is activated, determine whether or not the quality of the indoor air is within a set range, and recommend the user to deactivate the AOD of the dishwasher 1200. These processes will be described in detail.

The application may determine whether or not to activate the AOD function of the dishwasher 1200 (S120). For example, the application may open the pop-up window on the interface of the mobile device 1300, and receive, from the user through the pop-up window, a command related to whether or not to automatically open the door during the drying process.

When a command of not automatically opening the door is input from the user, a washing process is immediately performed, the application commends the dishwasher 1200 so as not to open the door, and in this case, the door is not automatically opened during the drying process.

When a command of activating the AOD function is input from the user, the application may determine whether or not the quality of the indoor air input from the air quality detection device 1100 is within a set range (S130).

Information on the quality of the indoor air may be transmitted from the air quality detection device 1100 to the mobile device 1300, and the application registered in the mobile device 1300 may determine whether or not the quality of the indoor air is within the set range.

When the quality of the indoor air is within the set range, since the quality of the indoor air is in a good state, the application may not transmit a separate command signal to the dishwasher 1200 and may maintain the AOD function in the dishwasher 1200.

In this case, the dishwasher 1200 may perform the washing process in a state in which the AOD function is activated. The set range for the quality of the indoor air may be appropriately selected in consideration of an acceptable range even when foreign substances penetrate into the dishwasher 1200.

When the quality of the indoor air deviates from the set range, the application may recommend the user to deactivate the AOD of the dishwasher 1200 (S140). When the quality of the indoor air deviates from the set range, the quality of the indoor air is in a bad state, and thus the application may display a text or emit a voice through the mobile device 1300 so as to recommend the user to deactivate the AOD.

The application may maintain or deactivate the AOD function of the dishwasher 1200 on the basis of the command input from the user.

When a command of maintaining the AOD function is input from the user, the application may not transmit a separate command signal to the dishwasher 1200, and the AOD function may be maintained in the dishwasher 1200.

When a command of deactivating the AOD function is input from the user, the application transmits a command signal of deactivating the AOD function to the dishwasher 1200, and the dishwasher 1200 does not automatically open the door during the drying process.

The dishwasher 1200 may wash the washing target in a state in which the AOD function is maintained or deactivated according to the performance of the respective processes described above (S160).

In the embodiment, when the quality of the indoor air is bad because many foreign substances are present in the indoor space, control is made to deactivate the AOD function in a drying operation of the dishwasher 1200, and thus the foreign substances may be effectively suppressed from penetrating into the dishwasher 1200 during the washing process for the dish and being thus attached to the dish.

Further, the application may recommend the user whether to maintain or deactivate the AOD function of the dishwasher 1200, and the determination is made according to the command of the user. Thus, the convenience of selection may be provided to the user.

Figure 5:
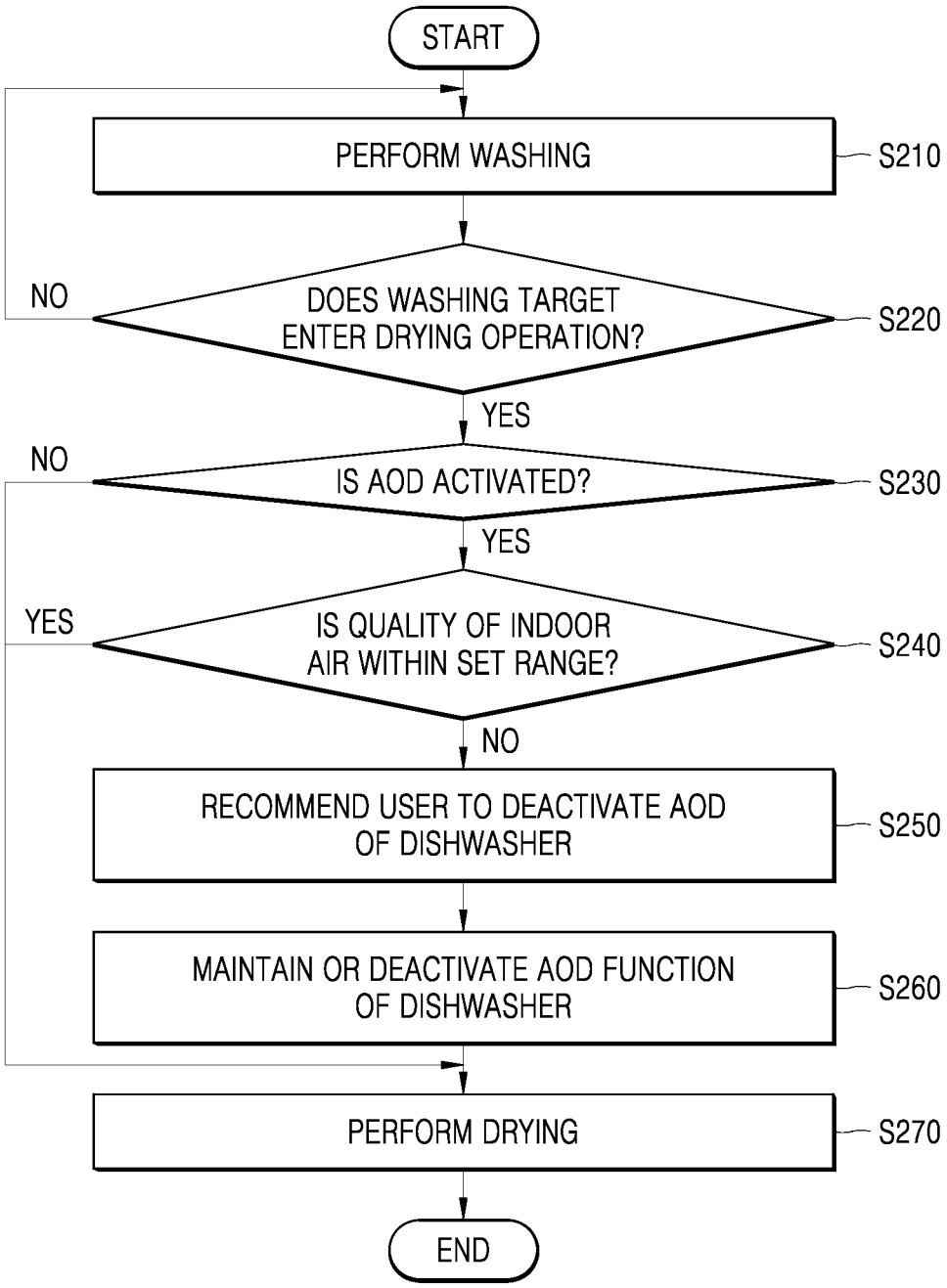
FIG. 5 is a flowchart illustrating a process of washing a washing target according to the embodiment.

FIG. 5 is a flowchart illustrating a process of washing a washing target according to the embodiment. The washing process in the dishwasher 1200 may include an operation of spraying the washing water to the dish and a drying operation of drying the dish after the washing water is completely sprayed.

The washing may be performed by the dishwasher 1200 (S210). The application may determine whether or not the washing target, that is, the dish, enters the drying operation (S220). The application may receive information on the washing process from the dishwasher 1200, and accordingly, may determine whether or not the washing target enters the drying operation due to the dishwasher 1200.

When the washing target enters the drying operation, the application may determine whether or not the AOD of the dishwasher 1200 is activated (S230). The application may receive control-related information from the dishwasher 1200 and, accordingly, determine whether or not the AOD is activated.

When the AOD is deactivated, the dishwasher 1200 performs the drying, and the door is not automatically opened during the entire drying operation.

When the AOD is activated, the application may determine whether or not the quality of the indoor air input from the air quality detection device 1100 is within a set range (S240).

The information on the quality of the indoor air may be transmitted from the air quality detection device 1100 to the mobile device 1300, and the application registered in the mobile device 1300 may determine whether or not the quality of the indoor air is within the set range.

When the quality of the indoor air is within the set range, since the quality of the indoor air is in a good state, the application may not transmit a separate command signal to the dishwasher 1200. In this case, the dishwasher 1200 may perform the drying in a state in which the AOD is activated.

When the quality of the indoor air deviates from the set range, the application may recommend the user to deactivate the AOD of the dishwasher 1200 (S250). When the quality of the indoor air deviates from the set range, the quality of the indoor air is in a bad state, and thus the application may display a text or emit a voice through the mobile device 1300 so as to recommend the user to deactivate the AOD.

The application may maintain or deactivate the AOD function of the dishwasher 1200 on the basis of the command input from the user.

When a command of maintaining the AOD function is input from the user, the application may not transmit a separate command signal to the dishwasher 1200, and the AOD function may be maintained in the dishwasher 1200.

When a command of deactivating the AOD function is input from the user, the application transmits the command signal of deactivating the AOD function to the dishwasher 1200, and the dishwasher 1200 does not automatically open the door during the drying process.

The dishwasher 1200 may dry the washing target in a state in which the AOD function is maintained or deactivated according to the performance of the respective processes described above (S270).

Figure 6:
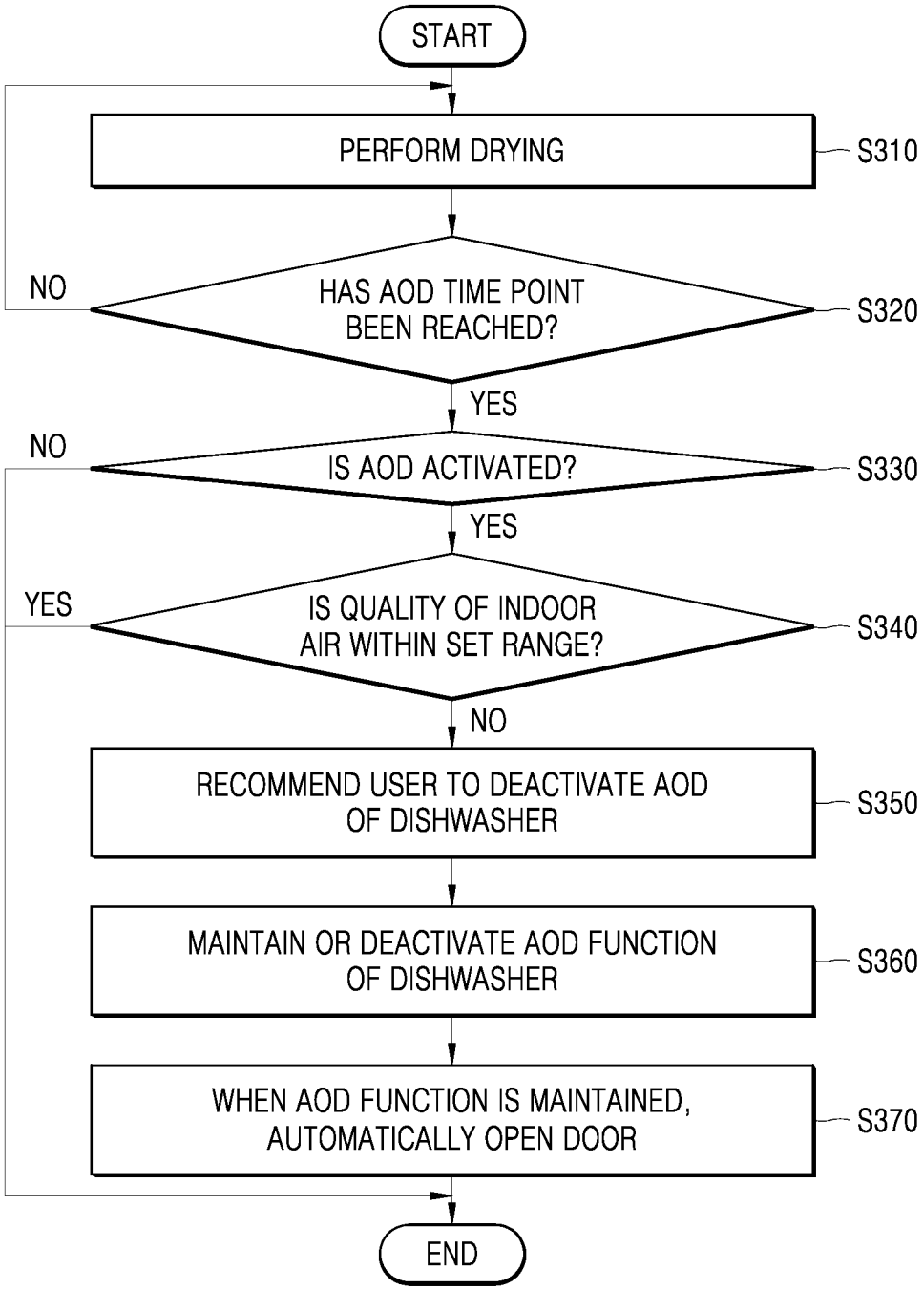
FIG. 6 is a flowchart illustrating a process of drying the washing target according to the embodiment.

FIG. 6 is a flowchart illustrating a process of drying the washing target according to the embodiment. In a drying operation of the dishwasher 1200, after the drying is performed for a certain period of time in a state in which the door is closed, the door is automatically opened, and the drying may be continuously performed.

In a state in which the door is closed, the washing target may be dried by the dishwasher 1200 (S310). The application may determine whether or not an AOD time point has been reached (S320). The application may receive information on the washing process from the dishwasher 1200 and, accordingly, may determine whether or not a time point when the door is automatically opened by the dishwasher 1200 has been reached.

When the AOD time point has been reached in the drying operation for the washing target, the application may determine whether or not the AOD of the dishwasher 1200 is activated (S330). The application may receive control-related information from the dishwasher 1200, and accordingly, determine whether or not the AOD is activated.

When the AOD is deactivated, the application may not transmit a separate command signal to the dishwasher 1200, and the dishwasher 1200 may continuously perform the drying in a state in which the door is not opened and is closed.

When the AOD is activated, the application may determine whether or not the quality of the indoor air input from the air quality detection device 1100 is within the set range (S340).

The information on the quality of the indoor air may be transmitted from the air quality detection device 1100 to the mobile device 1300, and the application registered in the mobile device 1300 may determine whether or not the quality of the indoor air is within the set range.

When the quality of the indoor air is within the set range, since the quality of the indoor air is in a good state, the application may not transmit a separate command signal to the dishwasher 1200. In this case, the dishwasher 1200 may open the door and continuously perform the drying.

When the quality of the indoor air deviates from the set range, the application may recommend the user to deactivate the AOD of the dishwasher 1200 (S350). When the quality of the indoor air deviates from the set range, the quality of the indoor air is in a bad state, and thus the application may display a text or emit a voice through the mobile device 1300 so as to recommend the user to deactivate the AOD.

The application may maintain or deactivate the AOD function of the dishwasher 1200 on the basis of the command input from the user (S360).

When the command of deactivating the AOD function is input from the user, the application may transmit the command signal of deactivating the AOD function to the dishwasher 1200, and the dishwasher 1200 may continuously perform the drying in a state in which the door is not opened and is closed.

When the command of maintaining the AOD function is input from the user, the application may not transmit a separate command signal to the dishwasher 1200.

When the AOD function of the dishwasher 1200 is maintained, the door of the dishwasher 1200 may be automatically opened (S370). In this case, the dishwasher 1200 may open the door and continuously perform the drying.

Figure 7:
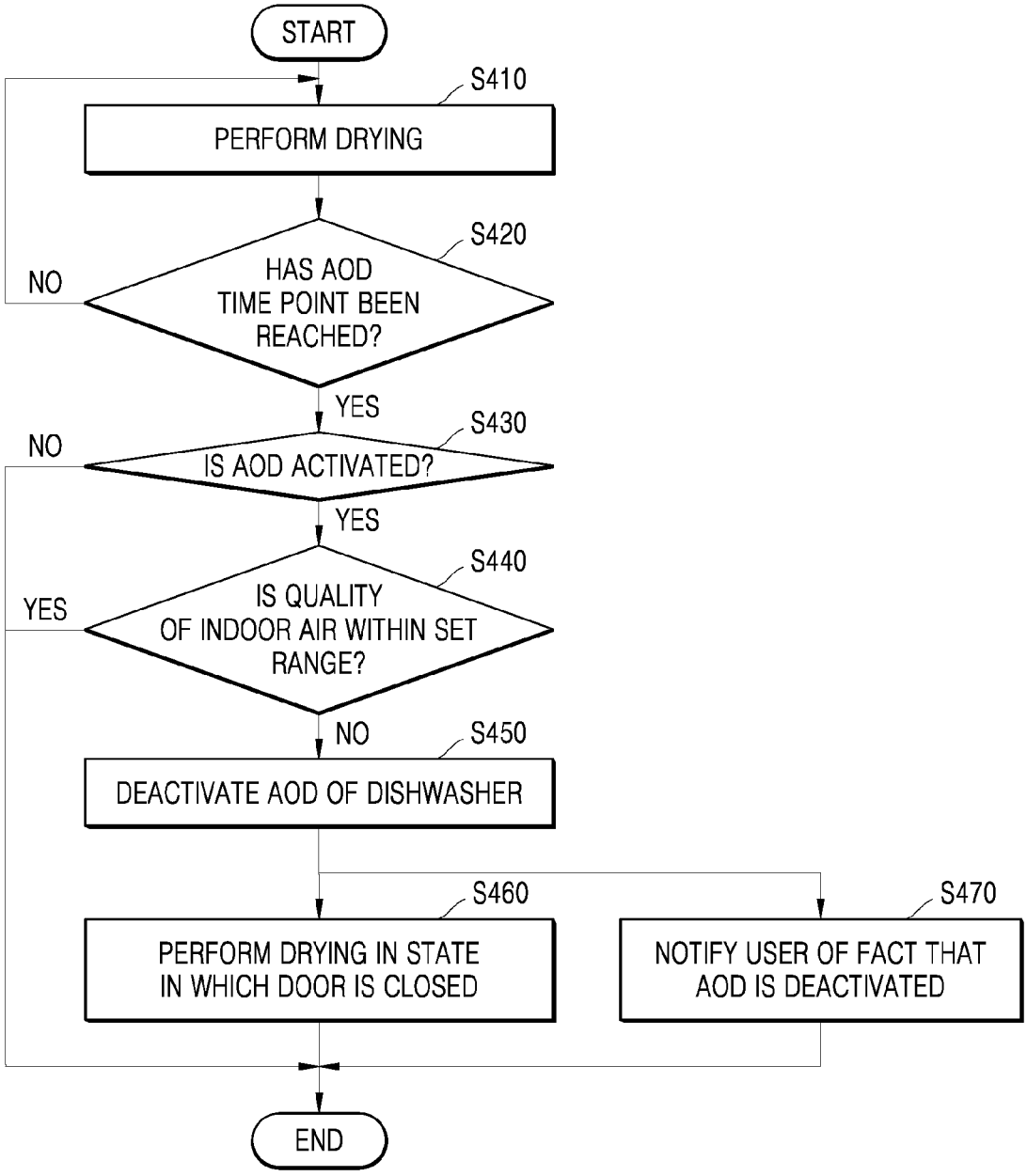
FIG. 7 is a flowchart illustrating a process of drying a washing target according to another embodiment.

FIG. 7 is a flowchart illustrating a process of drying a washing target according to another embodiment. Unlike the case illustrated in FIG. 6, in the drying of the washing target illustrated in FIG. 7, the application may maintain or deactivate the AOD function on the basis of determination of the application itself without depending on the command of the user.

In a state in which the door is closed, the washing target may be dried by the dishwasher 1200 (S410). The application may determine whether or not the AOD time point has been reached (S420). The application may receive information on the washing process from the dishwasher 1200 and, accordingly, may determine whether or not the time point when the door is automatically opened by the dishwasher 1200 has been reached.

When the AOD time point has been reached in the drying operation for the washing target, the application may determine whether or not the AOD of the dishwasher 1200 is activated (S430). The application may receive the control-related information from the dishwasher 1200 and, accordingly, may determine whether or not the AOD is activated.

When the AOD is deactivated, the application may not transmit a separate command signal to the dishwasher 1200, and the dishwasher 1200 may continuously perform the drying in a state in which the door is not opened and is closed.

When the AOD is activated, the application may determine whether or not the quality of the indoor air input from the air quality detection device 1100 is within the set range (S440).

The information on the quality of the indoor air may be transmitted from the air quality detection device 1100 to the mobile device 1300, and the application registered in the mobile device 1300 may determine whether or not the quality of the indoor air is within the set range.

When the quality of the indoor air is within the set range, since the quality of the indoor air is in a good state, the application may not transmit a separate command signal to the dishwasher 1200. In this case, the dishwasher 1200 may open the door and continuously perform the drying.

When the quality of the indoor air deviates from the set range, the AOD of the dishwasher 1200 may be deactivated (S450). In this case, the application transmits the command signal of deactivating the AOD function to the dishwasher 1200.

In operation S450, in order to suppress the dish washed with the washing water from being contaminated again duo to attachment of foreign substances to the dish, the application itself determines that there is a risk of contamination of the dish without receiving a command from the user, and thus closes the door.

In this case, the "set range of the quality of the indoor air" may be differently designated in operation S340 and operation S440. For example, in operation S440 in which the application itself deactivates the AOD function, the set range may be designated as a range in which the degree of contamination of the indoor air is high as compared to operation S340.

The dishwasher 1200 that has received the command signal of deactivating the AOD may perform the drying in a state in which the door is closed (S460). That is, when the AOD of the dishwasher 1200 is deactivated, in a state in which the door of the dishwasher 1200 is closed, the dishwasher 1200 may complete the drying of the washing target.

When the AOD is deactivated by the application, the application may notify the user of the fact that the AOD is deactivated (S470). Since the deactivating of the AOD is not expected by the user and may be a measure contrary to an intention of the user, it is necessary to notify the user of this fact.

The application may notify the user of the fact that the AOD is deactivated using a text or a voice through the interface of the mobile device 1300. In this regard, when the user wants to open the door of the dishwasher 1200 in the drying operation, the user may perform necessary actions such as deactivating the linking between the application and the dishwasher 1200.

Figure 8:
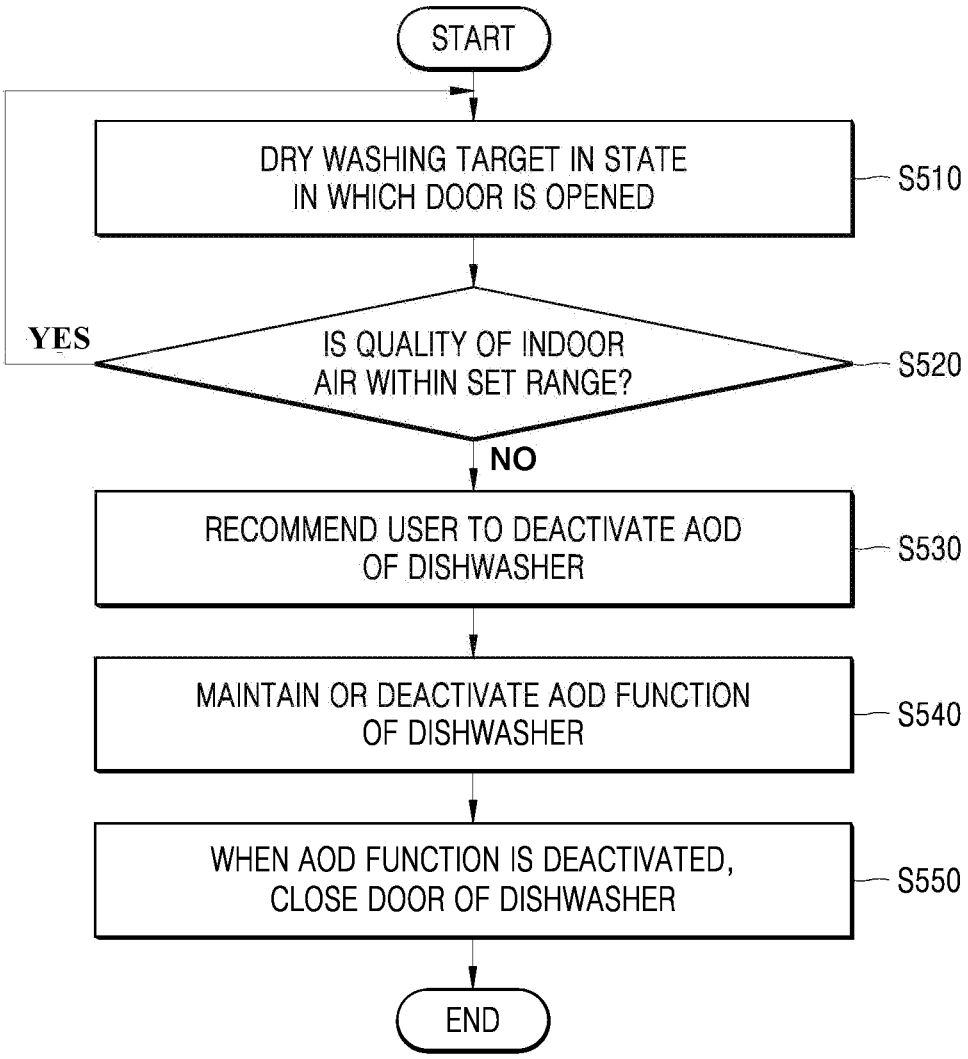
FIG. 8 is a flowchart illustrating a process of drying a washing target according to still another embodiment.

FIG. 8 is a flowchart illustrating a process of drying a washing target according to still another embodiment. Each operation illustrated in FIG. 8 may be performed during the process of drying the washing target in a state in which the door of the dishwasher 1200 is opened.

The dishwasher 1200 may dry the washing target in a state in which the door is opened (S510). The application may determine whether or not the quality of the indoor air input from the air quality detection device 1100 is within the set range (S520).

The information on the quality of the indoor air may be transmitted from the air quality detection device 1100 to the mobile device 1300, and the application registered in the mobile device 1300 may determine whether or not the quality of the indoor air is within the set range.

When the quality of the indoor air is within the set range, since the quality of the indoor air is in a good state, the application may not transmit a separate command signal to the dishwasher 1200. In this case, the dishwasher 1200 may continuously perform the drying in a state in which the door is opened.

When the quality of the indoor air deviates from the set range, the application may recommend the user to deactivate the AOD of the dishwasher 1200 (S530). When the quality of the indoor air deviates from the set range, the quality of the indoor air is in a bad state, and thus the application may display a text or emit a voice through the mobile device 1300 so as to recommend the user to deactivate the AOD.

The application may maintain or deactivate the AOD function of the dishwasher 1200 on the basis of the command input from the user (S540).

When the command of deactivating the AOD function is input from the user, the application may transmit the command signal of deactivating the AOD function to the dishwasher 1200.

When the AOD function of the dishwasher 1200 is deactivated, the door of the dishwasher 1200 may be closed (S550). The dishwasher 1200 may continuously perform the drying process in a state in which the door is closed. In this case, even after the drying is completed and all of the processes of washing the dish are completed, the door may remain in a closed state.

When the command of maintaining the AOD function is input from the user, the application may not transmit a separate command signal to the dishwasher 1200. In this case, the dishwasher 1200 may maintain the door to be open and continuously perform the drying. In this case, even after the drying is completed and all of the processes of washing the dish are completed, the door may remain in an open state.

Figure 9:
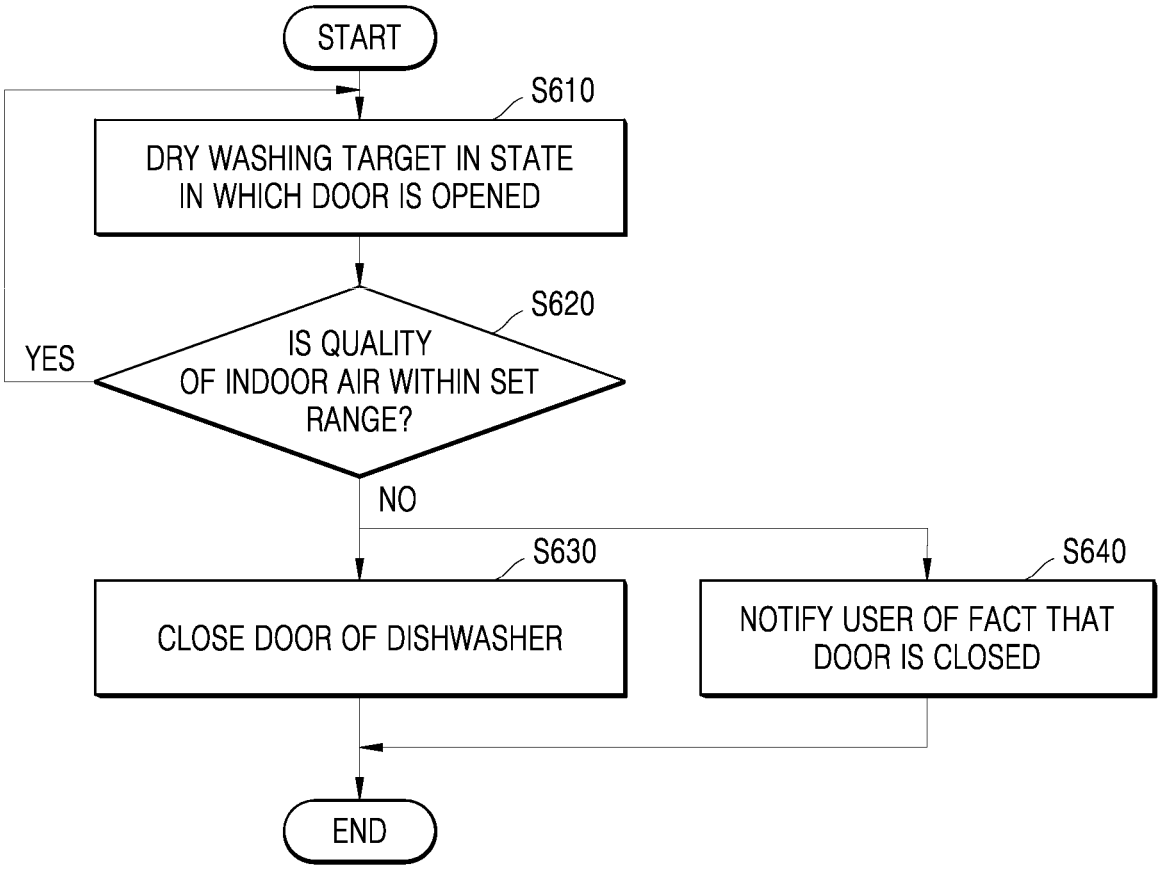
FIG. 9 is a flowchart illustrating a process of drying the washing target according to yet another embodiment.

FIG. 9 is a flowchart illustrating a process of drying the washing target according to yet another embodiment. Each operation illustrated in FIG. 9 may be performed during the process of drying the washing target in a state in which the door of the dishwasher 1200 is opened.

Unlike the case illustrated in FIG. 8, in the drying of the washing target illustrated in FIG. 9, the application may maintain or deactivate the AOD function on the basis of determination of the application itself without depending on the command of the user.

The dishwasher 1200 may dry the washing target in a state in which the door is opened (S610). The application may determine whether or not the quality of the indoor air input from the air quality detection device 1100 is within the set range (S620).

The information on the quality of the indoor air may be transmitted from the air quality detection device 1100 to the mobile device 1300, and the application registered in the mobile device 1300 may determine whether or not the quality of the indoor air is within the set range.

When the quality of the indoor air is within the set range, since the quality of the indoor air is in a good state, the application may not transmit a separate command signal to the dishwasher 1200. In this case, the dishwasher 1200 may continuously perform the drying in a state in which the door is opened. In this case, even after the drying is completed and all of the processes of washing the dish are completed, the door may remain in an open state.

When the quality of the indoor air deviates from the set range, the door may be closed (S630). The application may transmit the command signal of deactivating the AOD function to the dishwasher 1200, and the dishwasher 1200 may close the opened door in response to the command signal.

When the quality of the indoor air deviates from the set range, and thus the door is closed, the drying of the washing target may be completed in a state in which the door of the dishwasher 1200 is closed. In this case, even after the drying is completed and all of the processes of washing the dish are completed, the door may remain in a closed state.

In operation S630, in order to suppress the dish washed with the washing water from being contaminated again due to attachment of foreign substances to the dish, the application itself determines that there is a risk of contamination of the dish without receiving a command from the user, and thus closes the door.

In this case, the "set range of the quality of the indoor air" may be differently designated in operation S520 and operation S620. For example, in operation S620 in which the application itself deactivates the AOD function, the set range may be designated as a range in which the degree of contamination of the indoor air is high as compared to operation S520.

When the door is closed, the application may notify the user of the fact that the door is closed (S640). Since the performance of the drying in a state in which the door is opened and then the closing of the door again are not expected by the user, and may be a measure contrary to an intention of the user, it is necessary to notify the user of this fact.

The application may notify the user of the fact that the AOD is deactivated using a text or a voice through the interface of the mobile device 1300. In this regard, when the user wants to open the door of the dishwasher 1200 in the drying operation, the user may perform necessary actions such as deactivating the linking between the application and the dishwasher 1200.

In the embodiment, by controlling an operation of the door of the dishwasher 1200 using the mobile device 1300 carried by the user, a user's convenience can be increased.

Further, in the embodiment, an air purifier or an air conditioner that is a separate product that is already installed or is installable or an air contamination measurement device that is provided in each house in an apartment complex is used as the air quality detection device 1100 that detects the quality of the indoor air. Thus, since there is no need to add a separate device to the dishwasher 1200, manufacturing costs of the dishwasher 1200 can be reduced.

As described above, the present disclosure has been described with reference to the accompanying drawings, but the present disclosure is not limited by the embodiments disclosed in the present specification and the drawings, and various modifications may be made by those skilled in the art within the scope of the technical spirit of the present disclosure. In addition, although the effects according to the configuration of the present disclosure have not been explicitly described while the embodiments of the present disclosure are described, it is apparent that the effects predictable by the corresponding configuration should also be recognized.

What is claimed is:

1. A method of controlling a dishwasher, the method comprising:

linking, through an application registered in a mobile device, the mobile device to the dishwasher and an air quality detection device provided at an outside of the dishwasher;

determining whether an auto open door (AOD) function of the dishwasher is activated;

determining, based on a determination that the AOD function is activated, whether a contamination level of indoor air input from the air quality detection device is within a set range, the contamination level being determined based on a quantity of foreign substances in the air;

based on determining that the contamination level of the indoor air deviates from the set range, recommending a user of the dishwasher to deactivate the AOD function of the dishwasher;

maintaining or deactivating the AOD function of the dishwasher based on a command input from the user; and washing a washing target in the dishwasher.

2. The method of claim 1, wherein the application is configured to:

receive information regarding activation of the AOD function of the dishwasher, determine whether the contamination level of the indoor air is within the set range, and recommend the user to deactivate the AOD function of the dishwasher.

3. The method of claim 1, wherein washing the washing target includes:

determining whether a washing process of the dishwasher for the washing target enters a drying operation, determining whether the AOD function of the dishwasher is activated, determining whether the contamination level of the indoor air input from the air quality detection device is within the set range, based on determining that the contamination level of the indoor air deviates from the set range, recommending the user to deactivate the AOD function of the dishwasher, maintaining or deactivating the AOD function of the dishwasher based on a command input from the user, and drying the washing target.

4. The method of claim 3, wherein drying the washing target includes:

determining whether an automatically open door time point has been reached, determining whether the AOD function of the dishwasher is activated, determining whether the contamination level of the indoor air input from the air quality detection device is within the set range, based on determining that the contamination level of the indoor air deviates from the set range, recommending the user to deactivate the AOD function of the dishwasher, maintaining or deactivating the AOD function of the dishwasher based on a command input from the user, based on the AOD function of the dishwasher being maintained, automatically opening a door of the dishwasher, and drying the washing target in a state in which the door of the dishwasher is opened.

5. The method of claim 3, wherein drying the washing target includes:

determining whether an automatically open door point has been reached, determining whether the AOD function of the dishwasher is activated, determining whether the contamination level of the indoor air input from the air quality detection device is within the set range, and based on determining that the contamination level of the indoor air deviates from the set range, automatically deactivating the AOD function of the dishwasher.

6. The method of claim 5, further comprising notifying the user regarding the deactivation of the AOD function, wherein, based on the AOD function of the dishwasher being deactivated, drying of the washing target is completed in a state in which a door of the dishwasher is closed.

7. The method of claim 4, wherein drying the washing target in a state in which the door of the dishwasher is opened includes:

determining whether the contamination level of the indoor air input from the air quality detection device is within the set range, based on determining that the contamination level of the indoor air deviates from the set range, recommending the user to deactivate the AOD function of the dishwasher, maintaining or deactivating the AOD function of the dishwasher based on a command input from the user, and based on the AOD function of the dishwasher being deactivated, closing the door of the dishwasher.

8. The method of claim 4, wherein drying the washing target in a state in which the door of the dishwasher is opened includes:

determining whether the contamination level of the indoor air input from the air quality detection device is within the set range, based on determining that the contamination level of the indoor air deviates from the set range, closing the door of the dishwasher, and notifying the user that the door is closed.

9. The method of claim 8, wherein, based on the door being closed and determining that the contamination level of the indoor air deviates from the set range, drying of the washing target is completed in a state in which the door of the dishwasher is closed.

10. The method of claim 1, wherein the air quality detection device is disposed separately from the dishwasher in an indoor space in which the dishwasher is disposed.

11. The method of claim 1, wherein washing the washing target includes:

determining whether a washing process of the dishwasher for the washing target enters a drying operation, determining whether the AOD function of the dishwasher is activated, and based on determining that the AOD function of the dishwasher is not activated, drying the washing target.

12. The method of claim 1, wherein washing the washing target includes:

determining whether a washing process of the dishwasher for the washing target enters a drying operation, determining whether the AOD function of the dishwasher is activated, determining whether the contamination level of the indoor air input from the air quality detection device is within the set range, based on determining that the contamination level of the indoor air input from the air quality detection device is within the set range, drying the washing target.

13. The method of claim 1, wherein recommending the user of the dishwasher to deactivate the AOD function of the dishwasher includes displaying a text or emitting a voice through the mobile device.

* * * * *